US006935057B2

(12) United States Patent
Piana

(10) Patent No.: US 6,935,057 B2
(45) Date of Patent: Aug. 30, 2005

(54) TAGS OF DOUBLE THICKNESS, FOR MARKING ELECTRONIC ELEMENTS

(75) Inventor: Ivana Piana, Predosa (IT)

(73) Assignee: Grafoplast S.p.A., Predosa (IT)

( * ) Notice: Subject to any disclaimer, the term of this patent is extended or adjusted under 35 U.S.C. 154(b) by 87 days.

(21) Appl. No.: 10/213,591

(22) Filed: Aug. 7, 2002

(65) Prior Publication Data

US 2004/0026918 A1 Feb. 12, 2004

(51) Int. Cl.[7] ..... G09F 3/00
(52) U.S. Cl. ..... 40/316; 40/674
(58) Field of Search ..... 40/316, 299.01, 40/660, 674, 359, 638, 641; 174/112; 283/106, 36; 428/43

(56) References Cited

U.S. PATENT DOCUMENTS 4,004,362 A * 1/1977 Barbieri ..... 40/316
4,972,615 A * 11/1990 Grant ..... 40/641
5,111,605 A * 5/1992 Bossi ..... 40/316
5,462,783 A * 10/1995 Esselmann ..... 428/42.1
5,536,546 A * 7/1996 Nash ..... 428/43
6,284,338 B1 * 9/2001 Bauman et al. ..... 428/42.3
6,763,623 B2 * 7/2004 Piana ..... 40/316

FOREIGN PATENT DOCUMENTS

EP 1231586 A1 * 8/2002 ..... 40/316

* cited by examiner

*Primary Examiner*—Brian K. Green
(74) *Attorney, Agent, or Firm*—Richard M. Goldberg

(57) ABSTRACT

Printed tags of double thickness for marking electronic elements include first and second parallel, spaced apart strips. Tags of first and second sets have outer ends detachably connected to inner edges of the first and second strips, respectively, and extend toward the other strip. Each tag of the first and second sets have inner ends that extend in a lengthwise direction of the strips, with the inner ends of respective opposing tags of the first and second sets being connected together along a center line that extends in the lengthwise direction to form a tag pair. The tags of each connected tag pair are marked with identical indicia. The connected tags are folded along the center lines thereof so that the identically marked opposing connected tags are superimposed over each other to create tags of double thickness and double markings on both outer surfaces.

7 Claims, 3 Drawing Sheets

TAGS OF DOUBLE THICKNESS, FOR MARKING ELECTRONIC ELEMENTS

BACKGROUND OF THE INVENTION

This invention covers a marking system for electronic components (cables, systems, instruments, control panels etc.). Identification and marking systems consisting of elements or multiple tags on which characters or references are printed during production or by plotter based computer software have long been known. These marking systems, if compared with the manual composition of the marking elements permit fairly quick and accurate marking even for large marking series. However, plotter printing takes a rather long time as compared with the most vanguard printers now available on the market.

SUMMARY OF THE INVENTION

According to this invention, as a variation of the above described systems where the tags are composed of individual marking elements or computerised by plotter, the marking tags are now printed with a thermal transfer label printer.

According to this invention, the tags are obtained by die-cutting of a thin calendered film folded together so as to obtain tags of double thickness which permits to handle the tags and fit them in the supports of the electronic elements to be marked; this handling would have been impossible with tags having the same thickness as the calendered film which, as said before, is indeed very thin, while on the other hand the film has to be very thin to permit the utilisation of a thermal transfer label printer.

For this reason, the calendered and die-cutting sheet consists of two comb-shaped and opposed elements interconnected by the internal butt-jointed ends of the tags. The tags of these opposed comb-shaped elements are marked by the thermal transfer label printer and the tags are then superimposed by rotation along their central jointing line so as to obtain a comb-shaped element with tags having double thickness so that they can be more easily handled and fitted in their supports or directly mounted on the cables and equipments to be identified.

It should be stressed that both parts of the tags will be printed so that the comb thus obtained may be used by holding the lateral margin indifferently with the right or left hand.

An arrow shaping may be provided in the comb zone near the folding line to ensure a more stable fitting of the tag in its support or its fastening on the cables or equipment to be identified.

BRIEF DESCRIPTION OF THE DRAWINGS

The system, subject matter of this invention is illustrated in its practical and exemplified implementation in the attached drawings in which.

DETAILED DESCRIPTION

With reference to these figures, the tags are obtained from a continuous strip die-cutting from continuous calendered sheets.

Figure 1:
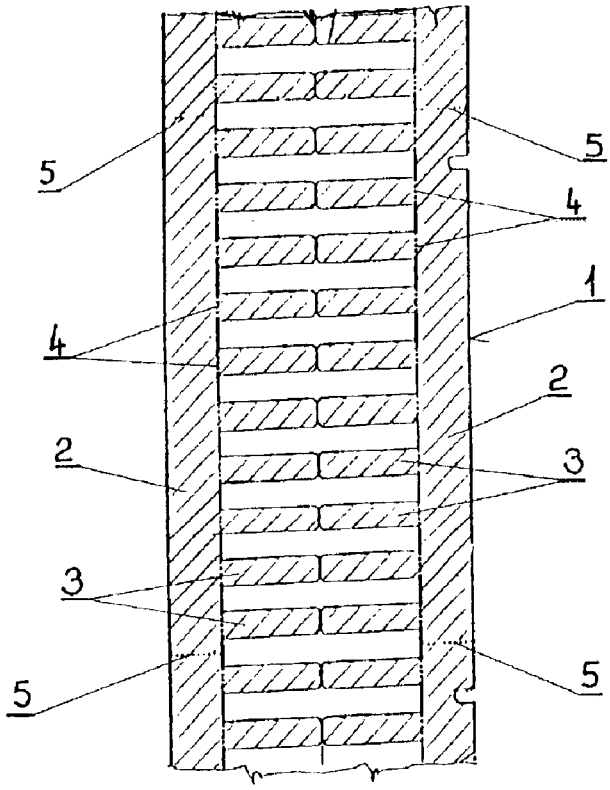
FIG. 1 shows a top view of calendered film after die-cutting.

The continuous strip 1 is illustrated in FIG. 1 and it is die-cut so as to obtain two lateral margins 2 interconnected by opposed tags 3 and butt jointed in the central part thus forming opposed comb-shaped elements.

The tags are attached to the lateral margins 2 by dotted pre-fracture lines 4. Other prefracture lines 5 permit the detachment of subsequent die-cutting strips.

Figure 2:
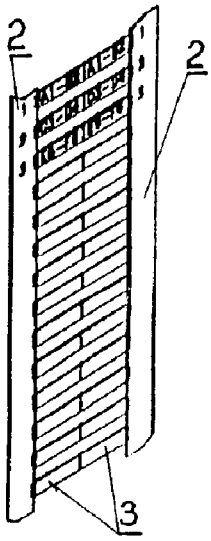
FIG. 2 shows a perspective view of the die-cutting film after the markings have been printed with a thermal transfer label printer.

The continuous strip is inserted in a thermal transfer label printer, so that the markings for the identification of electronic components, are printed on the inner tags of the strip as shown in FIG. 2.

Figure 3:
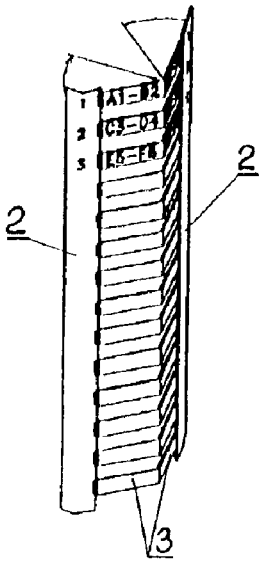
FIG. 3 shows a perspective view of the film being folded and superimposed as illustrated in FIG. 2.
Figure 4:
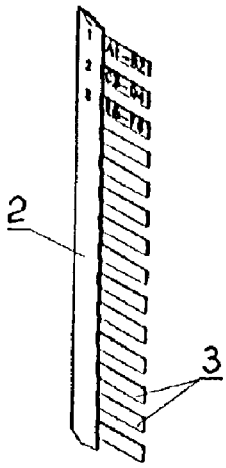
FIG. 4 shows a perspective view of the completely superimposed film illustrated in FIG. 2.
Figure 5:
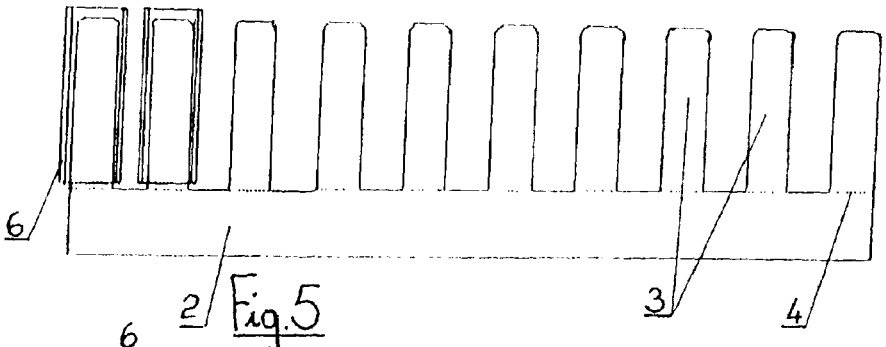
FIG. 5 shows a top view of the double thickness comb-shaped element provided with some supports for the tags.
Figure 6:
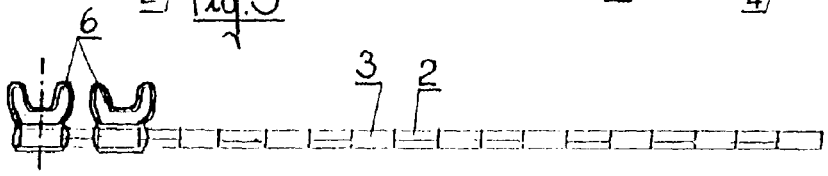
FIG. 6 shows a side view of the comb-shaped element of double thickness illustrated in FIG. 5.

The strip is then folded along the central jointing line of the tags shown in FIG. 3 until all tags 3 and lateral margins 2 are perfectly superimposed as shown in FIG. 4.

At this point, a comb-shaped configuration is achieved in which all marked tags are positioned in one direction and the supports 6, are applied on these tags; as is known, these supports 6 are featuring an upper transparent recess 7 in which to lodge the marked tag and a lower configuration 8 to secure the support 6 to the electronic instrument or component to be identified. After the support has been applied to the tag, the latter is detached from its lateral margin 2.

The identification marking is printed identically on both tag components so that the tag, after superimposition, can always be fitted in its support, irrespective of its orientation, and it can easily be handled, even by left-handed persons.

Figure 7:
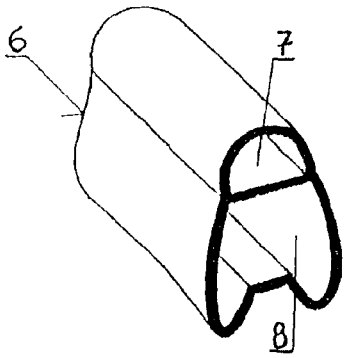
FIG. 7 shows a perspective view of an exemplified support for cable marking.
Figure 8:
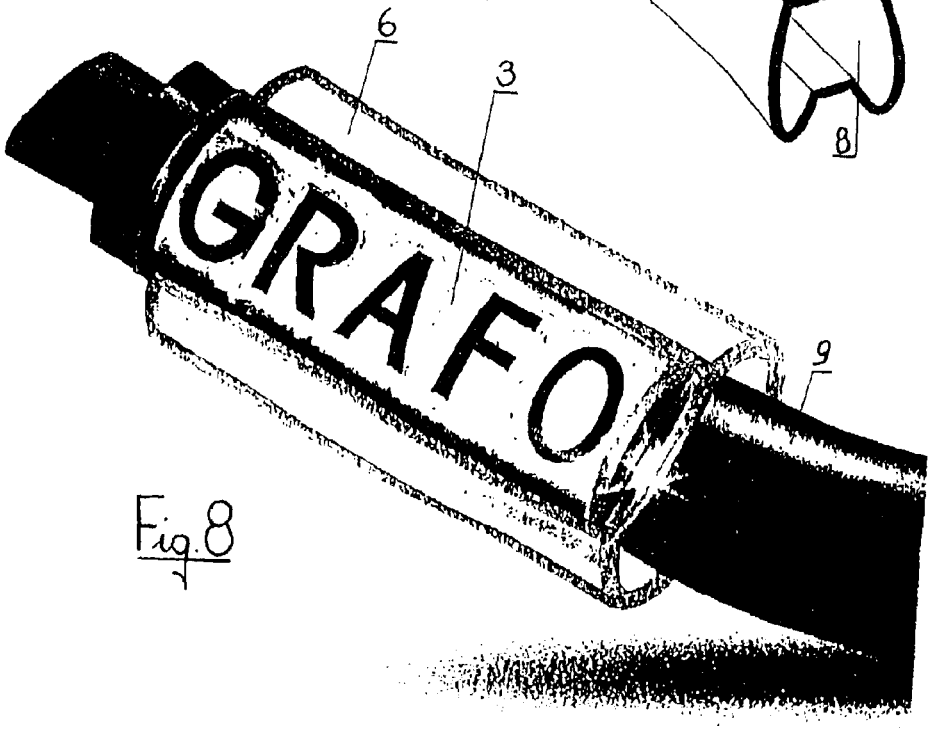
FIG. 8 shows a perspective view of an exemplified marked cable.
Figure 9:
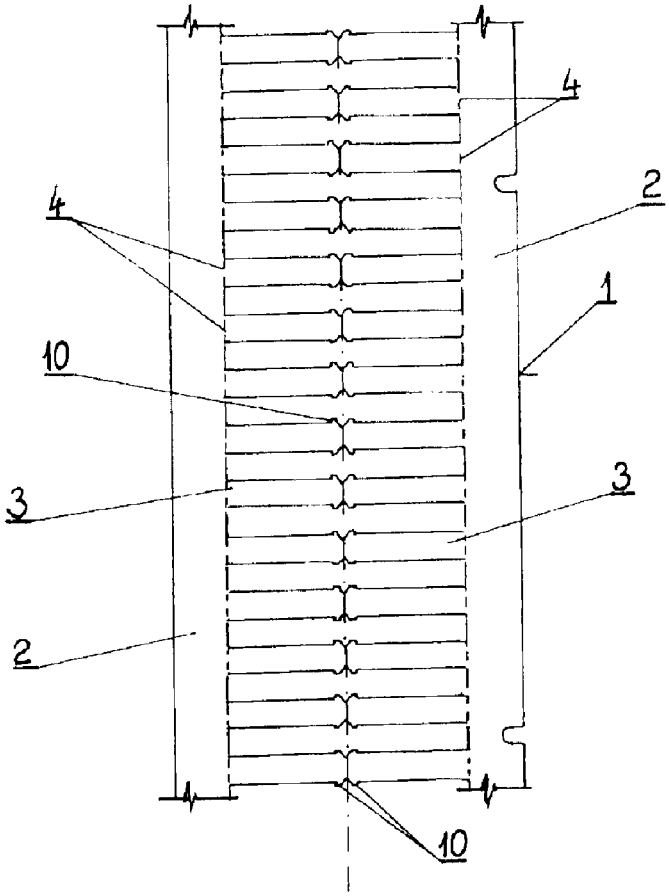
FIG. 9 shows a top view of the film illustrated in FIG. 1 with tags featuring arrow shapings along the folding area.
Figure 10:
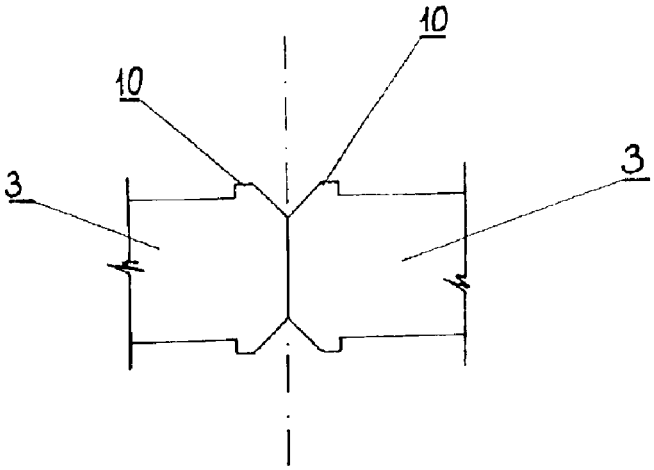
FIG. 10 shows a magnified detail of the arrow shaping illustrated in FIG. 9.

FIG. 7 shows for exemplification purposes a support 6 for the marking of a cable 9 featuring the exemplar characters "GRAFO" printed on the tag.

According to this invention, the lateral edges of the tags 3 and preferably their lateral ends feature small bulges 10 which may be of any nature but should be preferably arrow shaped to ensure stable installation of the tags in the supporting recess.

Therefore, according to this invention, a method is achieved for marking electronic components with the aid of a continuous strip with marking by a thermal transfer printer, then folded together after printing so that the printed tags can easily be handled and fitted in their supports to be fastened or directly applied on the equipment already provided with its own supports.

These new marking tags are compatible with all normal and known marking elements already produced by the Applicant and they may also be used in support or instead of the "Plotter System" series where a normal plotter is used for marking of the tags.

What is claimed is:

1. Printed multiple tags of double thickness for marking electrotechnical and/or electronic elements, comprising:

first and second elongated margin stripe which are separated in parallel, spaced apart relation and which extend in an elongated manner primarily in a first direction as a lengthwise direction thereof, a first set of tags, each tag of the first set of tags having an outer end detachably connected to an inner edge of the first margin strip and extending in a second direction substantially transverse to said first direction toward said second strip, each tag of the first set of tags having a width as measured in said first direction which is much less than a length of said first margin strip as measured in said first direction, a second set of tags, each tag of the second set of tags having an outer end detachably connected to an inner edge of the second margin strip and extending in the second direction substantially transverse to said first direction toward said first strip so as to be in alignment with a respective opposing tag of the first set of tags, each tag of the second set of tags having a width as measured in said second direction which is much less than a length of said first margin strip as measured in said first direction.

each of the tags of the first and second sets of tags having inner lateral ends that extend in the lengthwise direction of the margin strips, with the inner lateral ends of respective opposing tags of the first and second sets of tags being connected together along a center line that extends in said lengthwise direction to form a tag pair, each tag of the first set of tags being supported only by the outer end connection thereof to said first margin strip and by the inner lateral end connection thereof at the centerline to a respective inner lateral end of another tag of the second set of tags, and with edges of each tag of the first set of tags between the outer end connection and inner lateral end connection thereof being unconnected, each tag of the second set of tags being supported only by the outer end connection thereof to said second margin strip and by the inner lateral end connection thereof at the centerline to a respective inner lateral end of another tag of the first set of tags, and with edges of each tag of the second set of tags between the outer end connection and inner lateral end connection thereof being unconnected, the tags of each connected tag pair being marked with identical indicia, the connected tags of each connected tag pair being folded along the center line thereof so that said identically marked opposing connected tags are superimposed over each other to create tags of double thickness and double markings on both outer surfaces thereof such that said double thickness tags are adapted to be placed in supports adapted to be fitted on electronic elements to be identified, after being detached from their respective margin strips.

2. Printed multiple tags of double thickness according to claim 1, wherein each said tag has a substantially rectangular configuration.

3. Printed multiple tags of double thickness according to claim 1, wherein each said tag is connected at the outer end thereof to a respective margin strip by a dotted prefracture line.

4. Printed multiple tags of double thickness according to claim 1, wherein said tags of said first set of tags are spaced apart in a lengthwise direction of said first margin strip to provide first open air areas, and said tags of said second set of tags are spaced apart in a lengthwise direction of said second margin strip to provide second open air areas.

5. Printed multiple tags of double thickness for marking electrotechnical and/or electronic elements, comprising:

first and second margin strips which are separated in parallel, spaced apart relation, a first set of tags, each having an outer end detachably connected to an inner edge of the first margin strip and extending toward said second strip, a second set of tags, each having an outer end detachably connected to an inner edge of the second margin strip and extending toward said first strip so as to be in a alignment with a respective opposing tag of the first set of tags, each of the tags of the first and second sets of tags having inner lateral ends that extend in a lengthwise direction of the margin strips, with the inner lateral ends of respective opposing tags of the first and second sets of tags being connected together along a center line that extends in said lengthwise direction to form a tag pair, each tag of the first set of tags being supported only by the outer end connection thereof to said first margin strip and by the inner lateral end connection thereof at the centerline to a respective inner lateral end of another tag of the second set of tags, each tag of the second set of tags being supported only by the outer end connection thereof to said first margin strip and by the inner lateral end connection thereof at the centerline to a respective inner lateral end of another tag of the first set of tags, the tags of each connected tag pair being marked with identical indicia, the connected tags of each connected tag pair being folded along the center line thereof so that said identically marked opposing connected tags are superimposed over each other to create tags of double thickness and double markings on both outer surfaces thereof such that said double thickness tags are adapted to be placed in supports adapted to be fitted on electronic elements to be identified, after being detached from their respective margin strips, and the inner lateral ends of the tags have small bulges in unfolded and folded configurations to ensure stable installation of the tags in supporting recesses of the supports.

6. Printed multiple tags of double thickness according to claim 5, wherein the small bulges are substantially arrow shaped.

7. Printed multiple tags of double thickness for marking electrotechnical and/or electronic elements, comprising:

first and second margin strips which are separated in parallel, spaced apart relation, a first set of tags, each having an outer end detachably connected to an inner edge of the first margin strip and extending toward said second strip, a second set of tags, each having an outer end detachably connected to an inner edge of the second margin strip and extending toward said first strip so as to be in alignment with a respective opposing tag of the first set of tags, each of the tags of the first and second sets of tags having inner lateral ends that extend in a lengthwise direction of the margin strips, with the inner lateral ends of respective opposing tags of the first and second sets of tags being connected together along a center line that extends in said lengthwise direction to form a tag pair, each tag of the first set of tags being supported only by the outer end connection thereof to said first margin strip and by the inner lateral end connection thereof at the centerline to a respective inner lateral end of another tag of the second set of tags, each tag of the second set of tags being supported only by the outer end connection thereof to said second margin strip and by the inner lateral end connection thereof at the centerline to a respective inner lateral end of another tag of the first set of tags, the tags of each connected tag pair being marked with identical indicia, the connected tags of each connected tag pair being folded alone the center line thereof so that said identically marked opposing connected tags are superimposed over each other to create tags of double thickness and double markings on both outer surfaces thereof such that said double thickness tags are adapted to be placed in supports adapted to be fitted on electronic elements to be identified, after being detached from their respective margin strips, said tags of said first set of tags are spaced apart in a lengthwise direction of said first margin strip to provide first open air areas, and said tags of said second set of tags are spaced apart in a lengthwise direction of said second margin strip to provide second open air areas, and dotted prefracture lines on said margin strips at positions between adjacent pairs of opposing connected tags in alignment with said open air areas.

* * * * *